US009478884B2

(12) United States Patent
Tsai et al.

(10) Patent No.: US 9,478,884 B2
(45) Date of Patent: Oct. 25, 2016

(54) ELECTRICAL CONNECTOR HAVING AN INSULATIVE PLATE WITH A SLOT

(71) Applicant: FOXCONN INTERCONNECT TECHNOLOGY LIMITED, Grand Cayman (KY)

(72) Inventors: Kuei-Chung Tsai, New Taipei (TW); Yue-Ou Zhang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 28 days.

(21) Appl. No.: 14/548,575

(22) Filed: Nov. 20, 2014

(65) Prior Publication Data

US 2015/0140866 A1 May 21, 2015

(30) Foreign Application Priority Data

Nov. 20, 2013 (CN) ..... 2013 1 0583508

(51) Int. Cl.
*H01R 12/72* (2011.01)

(52) U.S. Cl.
CPC ..... *H01R 12/724* (2013.01)

(58) Field of Classification Search
CPC ..... H01R 12/724; H01R 13/6273; H01R 13/6593
USPC ..... 439/660, 607.4, 637
See application file for complete search history.

(56) References Cited

U.S. PATENT DOCUMENTS 4,846,734 A * 7/1989 Lytle ..... H01R 12/721 439/637
7,578,703 B2 * 8/2009 Hsiao ..... G06K 7/0021 439/159
7,625,240 B2 * 12/2009 Hayden, Sr. ..... H01R 13/64 439/637
8,578,257 B2 11/2013 Kim et al.
8,591,257 B2 * 11/2013 Girard ..... H01R 13/6473 439/607.07

(Continued)

FOREIGN PATENT DOCUMENTS

CN 201608369 U 10/2010
CN 202513385 U 10/2012
WO 2012018626 A 2/2012

*Primary Examiner* — Tulsidas C Patel
*Assistant Examiner* — Marcus Harcum
(74) *Attorney, Agent, or Firm* — Wei Te Chung; Ming Chieh Chang

(57) ABSTRACT

An electrical connector including an insulative housing defining a mating port in a transverse direction, a top wall and a bottom wall horizontally extending in two sides of the mating port, and a number of terminal passageways; and a terminal module received in the insulative housing, the terminal module comprising an insulative plate extending along the transverse direction and a number of conductive terminals insert molded in the insulative plate, the conductive terminal having a fixed section in the insulative plate and a contact section extending from the fixed section and received in a corresponding terminal passageway, the conductive terminals comprising a number of pairs of differential signal terminals for transmitting differential signal; wherein the insulative plate has a number of slots, the slot having two opposite edges, the pair of signal terminals having closer inner edges, the inner edge being between two opposite edges of the slot.

14 Claims, 12 Drawing Sheets

(56) References Cited

U.S. PATENT DOCUMENTS 8,858,237 B2 * 10/2014 Hsu ..... H01R 13/514 439/60
2006/0014438 A1 * 1/2006 Regnier ..... H01R 12/721 439/637
2010/0297888 A1 * 11/2010 Lim ..... H01R 12/707 439/660
2010/0330849 A1 * 12/2010 Wang ..... H01R 13/65802 439/701
2011/0070779 A1 * 3/2011 Zhang ..... H01R 12/712 439/660
2013/0196550 A1 * 8/2013 Casher ..... H01R 12/724 439/660
2013/0217263 A1 8/2013 Pan
2013/0309906 A1 * 11/2013 De Geest ..... H01R 13/6477 439/607.31
2015/0333460 A1 11/2015 Regnier et al.

* cited by examiner

ELECTRICAL CONNECTOR HAVING AN INSULATIVE PLATE WITH A SLOT

BACKGROUND OF THE INVENTION

1. Field of the Invention

The present invention relates to an electrical connector and especially relates to an insulative plate of a terminal module in such electrical connector.

2. Description of Related Art

U.S. Patent Application Publication No. 2013/0196550 discloses an electrical connector including a terminal block and a set of terminals insert molded in the terminal block for preferential coupling. The terminals include a first and second differential pair. Specifically, each of the terminals includes a tail, a contact, and a body, wherein the body has a block portion and a free portion. The block portion is positioned in the terminal block and has a first width and the free portion has a second width greater than the first width.

U.S. Patent Application Publication No. 2013/0217263 discloses a backplane connector wherein a pair of differential signal contacts in a contact wafer are so arranged that near edges of intermediate portions of the differential pair are exposed to air in order to improve impedance.

An electrical connector having a good performance at high frequency is desired.

SUMMARY OF THE INVENTION

Accordingly, an object of the present invention is to provide an electrical connector requiring an insulative plate with a number of slots in order to achieve a good performance of high frequency.

In order to achieve the object set forth, the invention provides an electrical connector comprising: an insulative housing defining a mating port in a transverse direction, a top wall and a bottom wall horizontally extending in two sides of the mating port, and a plurality of terminal passageways; and a terminal module received in the insulative housing, the terminal module comprising an insulative plate extending along the transverse direction and a plurality of conductive terminals insert molded in the insulative plate, the conductive terminal having a fixed section in the insulative plate and a contact section extending from the fixed section and received in a corresponding terminal passageway, the conductive terminals comprising a plurality of pairs of differential signal terminals for transmitting differential signal; wherein the insulative plate has a plurality of slots, the slot having two opposite edges, the pair of signal terminals having closer inner edges, the inner edge being between two opposite edges of the slot.

Other objects, advantages and novel features of the invention will become more apparent from the following detailed description when taken in conjunction with the accompanying drawings.

DETAILED DESCRIPTION OF THE PREFERRED EMBODIMENT

Figure 1:
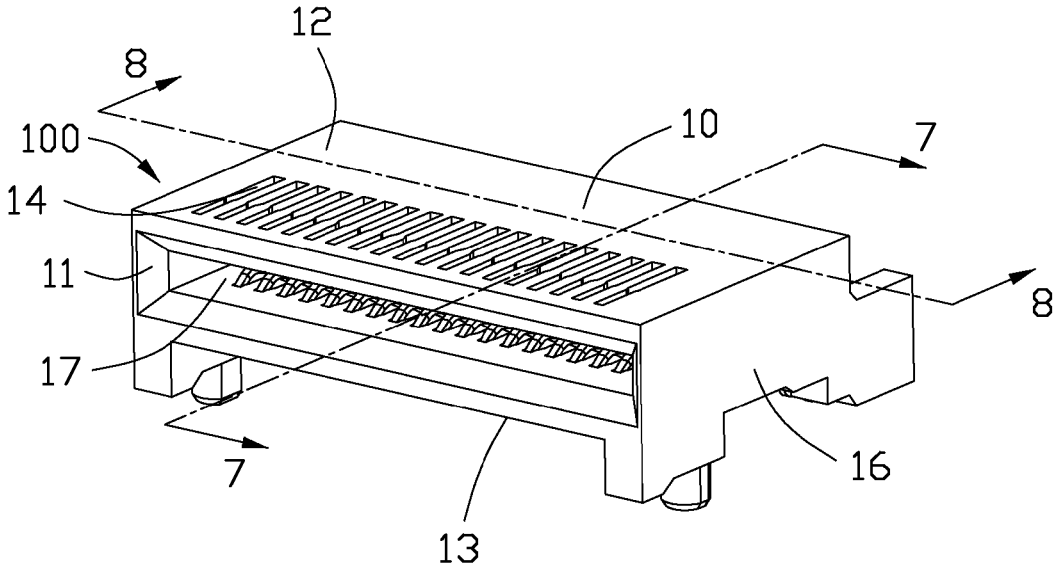
FIG. 1 is a perspective view of an electrical connector according to the present invention.
Figure 2:
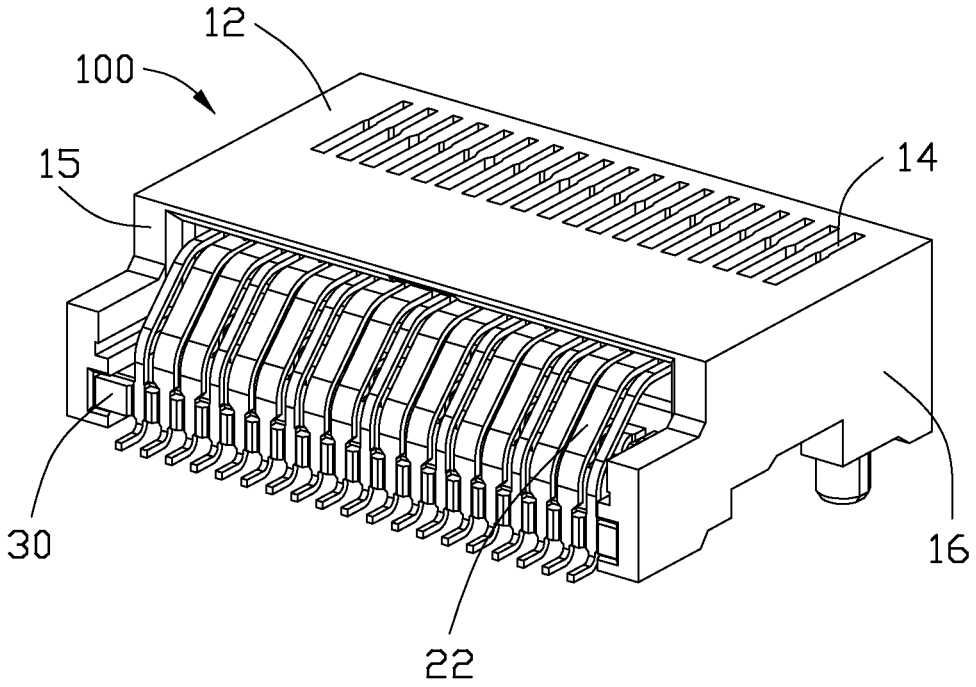
FIG. 2 is another perspective view of an electrical connector as shown in FIG. 1.
Figure 3:
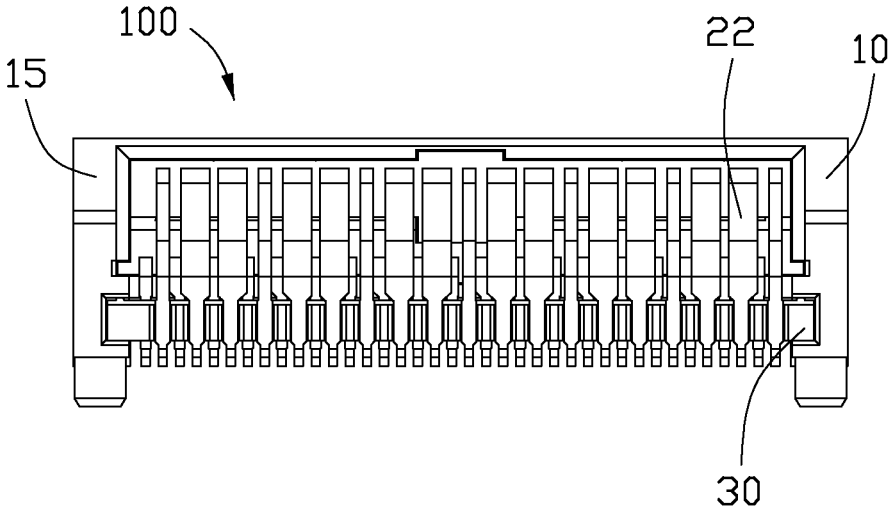
FIG. 3 is a rear view of the whole cable connector according to the present invention.

Reference will now be made in detail to the preferred embodiment of the present invention.

Referring to FIGS. 1-5, an electrical connector 100 includes an insulative housing 10 and a terminal module 20 received in the insulative housing 10.

The insulative housing 10 defines an elongated mating port 11, a top wall 12, a bottom wall 13 and a plurality of terminal passageway 14 in the top wall 12 and the bottom wall 13 and a rear face 15 for terminal module 20 mounted into the insulative housing 10 from back to front. The top wall 12 and the bottom wall 13 horizontally extending in two sides of the mating port 11. The terminal module 20 includes an upper terminal module 201 and a lower terminal module 202 mounted over the upper terminal module 201. Each terminal module 20 includes an insulative plate 21 extending along a transverse direction and a plurality of conductive terminals 22 inserted and arranged along the transverse direction. The upper terminal module 201 includes a first insulative plate 203. The lower terminal module 202 includes a second insulative plate 204. The first insulative plate 203 aligned with the second insulative plate 204 and set together.

Figure 10:
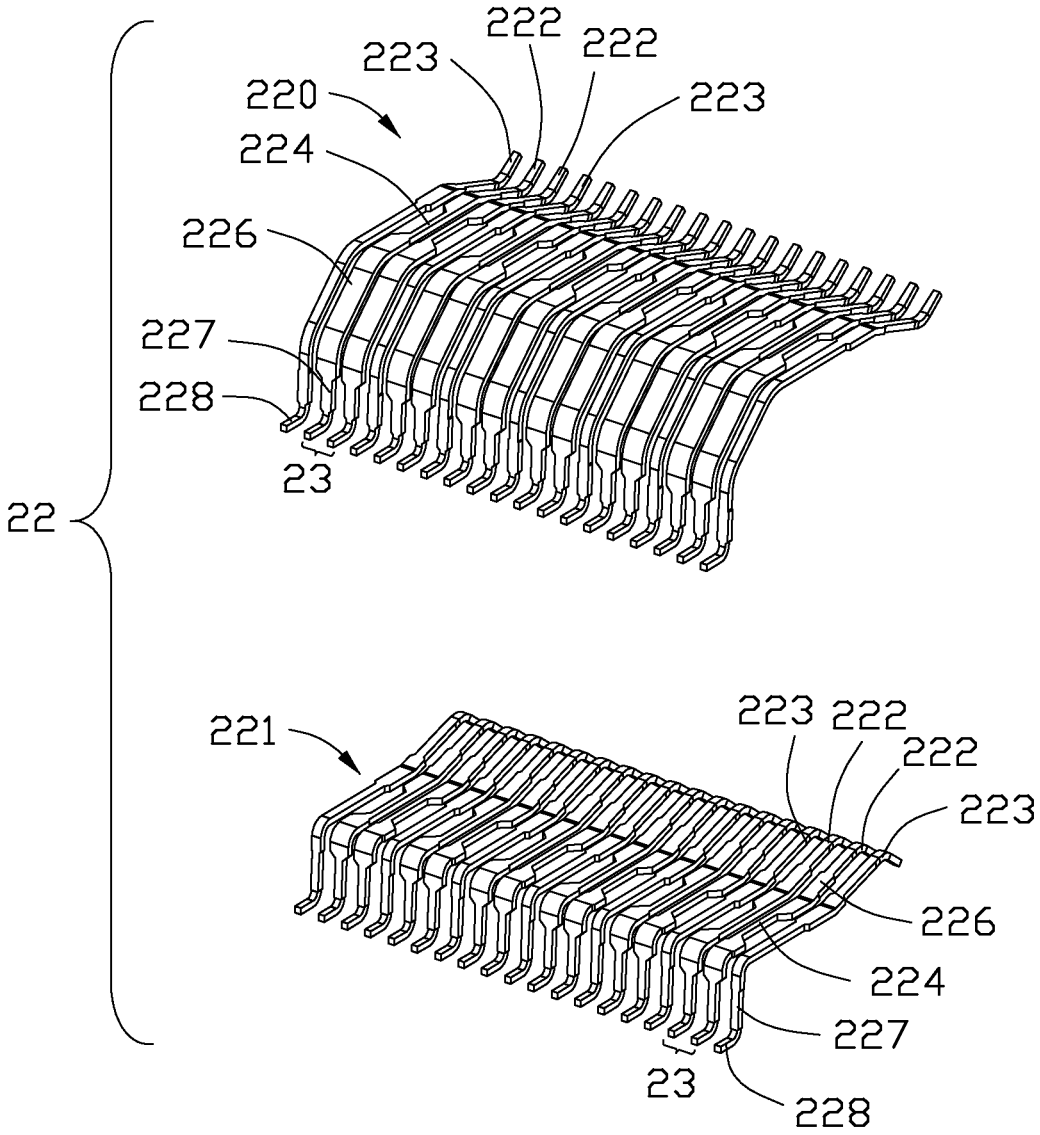
FIG. 10 is a perspective view of the conductive terminal according to the present invention.
Figure 11:
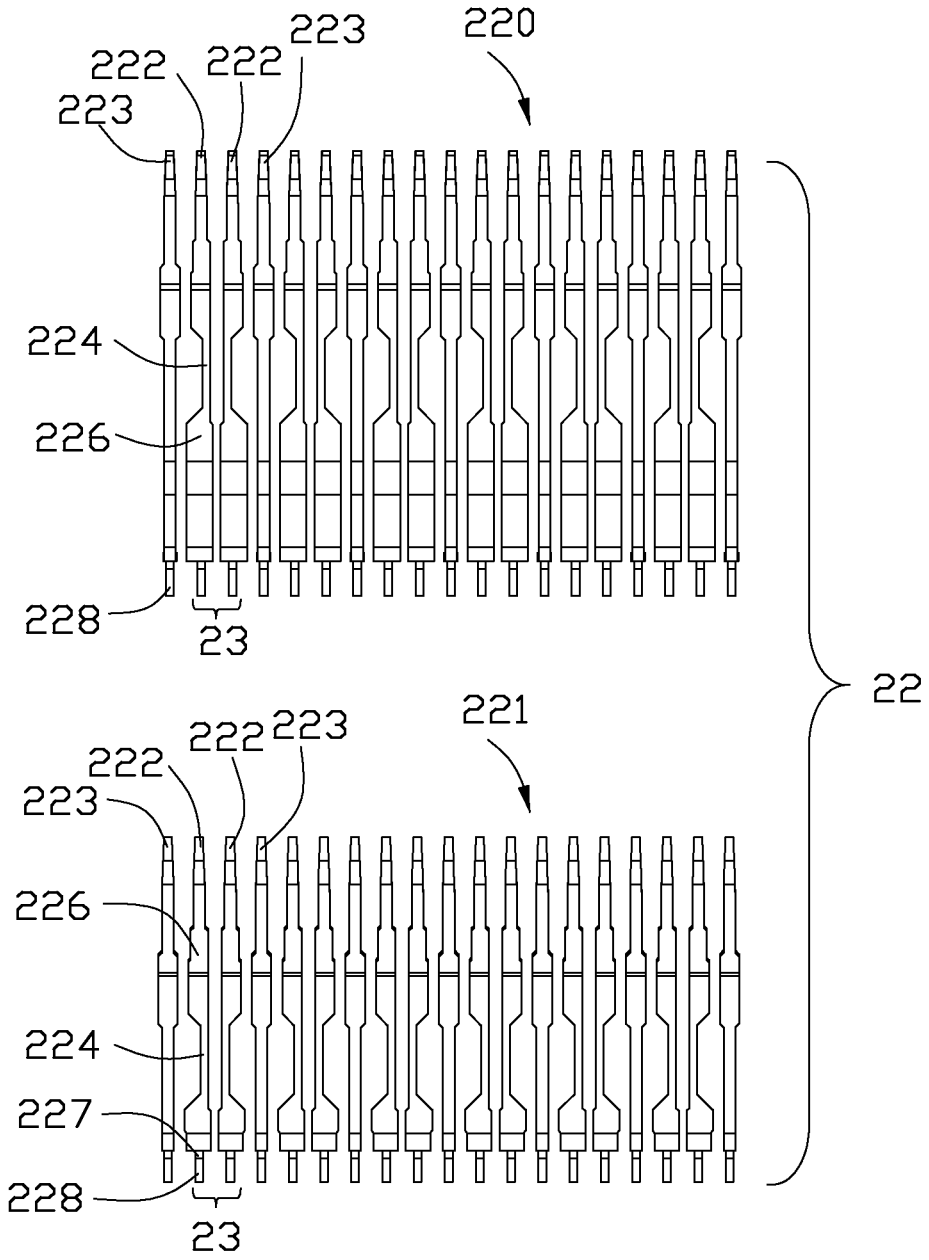
FIG. 11 is a palace view of the conductive terminal according to the present invention.

Referring to FIG. 10 and FIG. 11, the conductive terminal 22 includes a first conductive terminal 220 of the upper terminal module 201 and a second conductive terminal 221 of the lower terminal module 202. The conductive terminal 22 includes a number of signal terminals 222 and a number of ground terminals 223. Two adjacent signal terminals 222 form a pair of differential signal terminal 23. Set one ground terminal 223 at two sides of each pair of differential signal terminal 23.

Referring to FIGS. 6-10, the conductive terminal 22 having a fixed section 224 inserted in the insulative plate 21 and a contact section 225 extending from the fixed section 224. The fixed section 224 extends along a front-to-back direction in a level. A part of the contact section 225 is received in a corresponding terminal passageway 14. Because of the fixed section 224 inserted in the insulative plate 21, the impedance of the fixed section 224 reduces. So the performance of high frequency of the whole electrical connector 100 becomes worse. Define a number of slots 24 in the insulative plate 21 for the fixed section 224 connecting with the air. Then the impedance of the fixed section 224 gets increase and the performance of high frequency gets improve. The slots 24 of the upper terminal module 201 are defined on the upper surface of the first insulative plate 203. The slots 24 of the lower terminal module 202 are defined on the lower surface of the second insulative plate 204. The slots 24 opened from one side of the insulative plate 21 to the conductive terminal, the part of the signal terminal 23 corresponding to the slot 24 exposed in the air.

Figure 12:
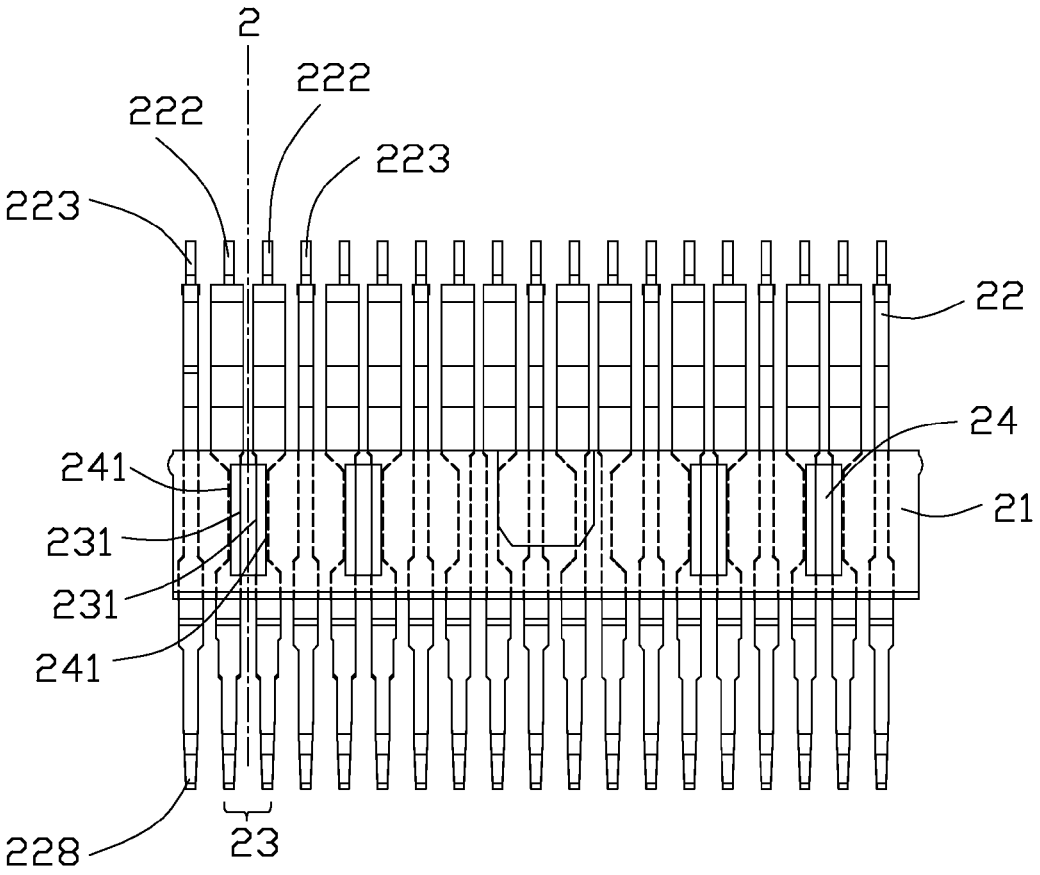
FIG. 12 is a positional relationship of a part of the conductive terminal inserted in the insulative plate and the slot in the insulative plate.

Referring to FIG. 12, each pair of differential signal terminals 23 corresponds to one slot 24. The center line 2 of the slot 24 is between one pair of the differential signal terminals 23 by projection in a vertical direction perpendicular to the transverse direction. The slot 24 has two opposite edges 241, the pair of differential signal terminals 23 having closer inner edges 231. The inner edge 231 is between two opposite edges 241 of the slot 24.

Referring to FIGS. 10-12, the conductive terminal 22 further includes a free section 226, a holding section 227 backward extending from the fixed section 224 and a soldering section 228 vertically extending from the holding section 227. The width of the fixed section 224 is smaller than the width of the free section 226. The distance of the fixed section 224 of two adjacent signal terminals 222 is smaller than the distance of a signal terminal 222 and a ground terminal 223 adjacent to the signal terminal 222. Thus, this design reduces the cross talk of the signal terminal 222.

Figure 4:
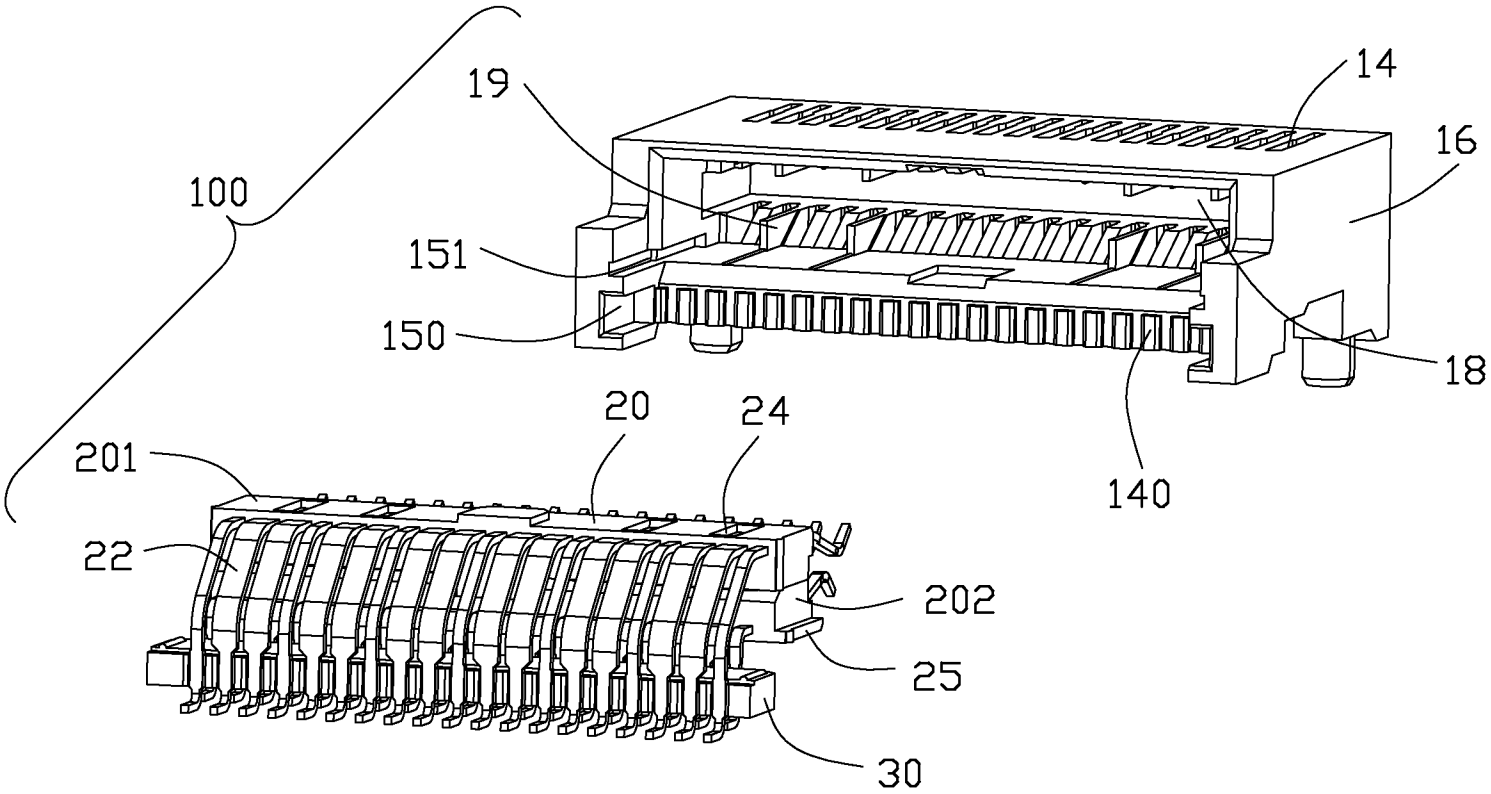
FIG. 4 is a perspective view of the terminal module separating from the insulative housing according to the present invention.
Figure 6:
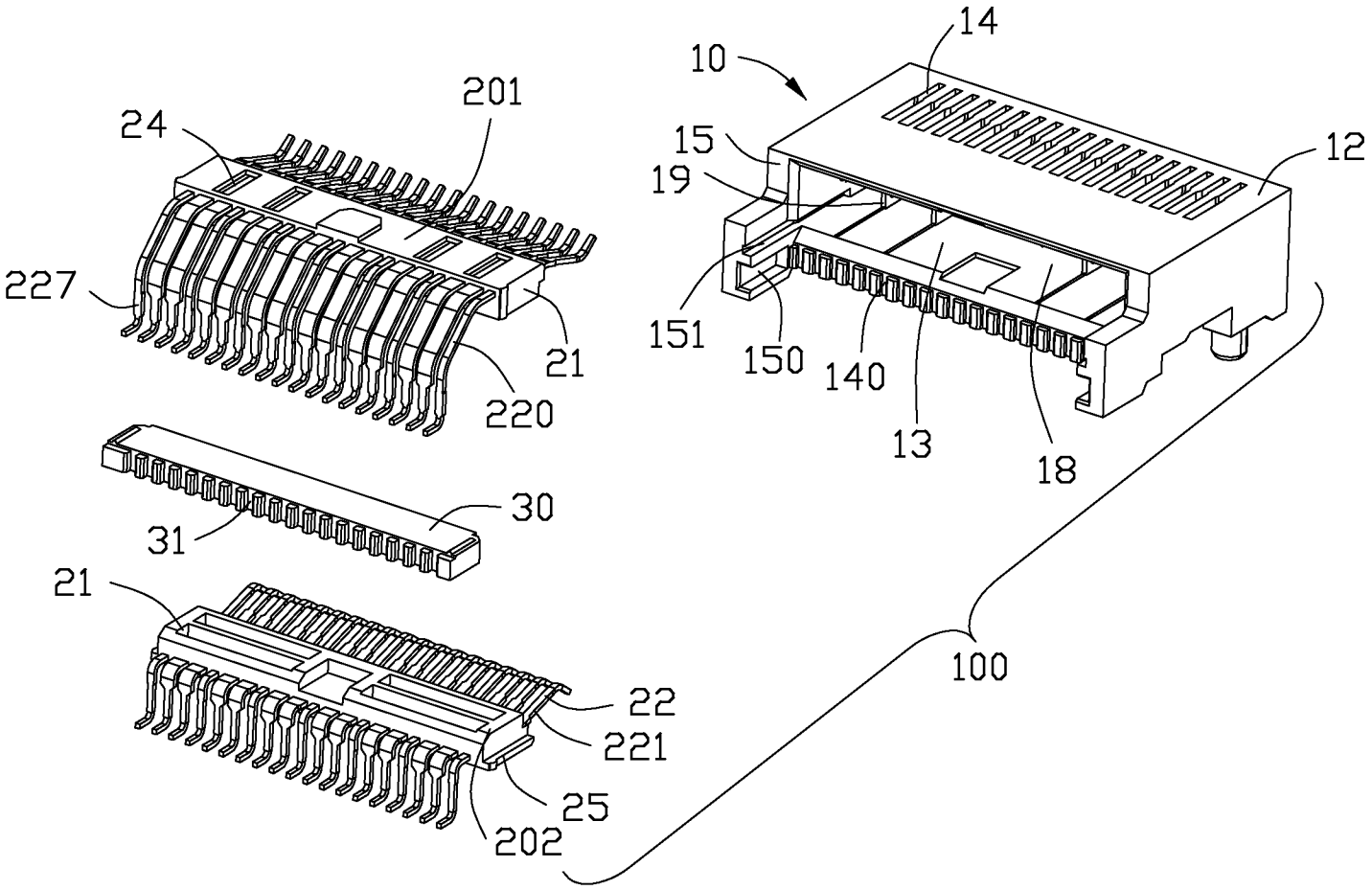
FIG. 6 is an explosive view of the electrical connector according to the present invention.

Referring to FIG. 4 and FIG. 6, the electrical connector 100 further includes a position part 30. The insulative housing 10 further includes two side walls 16 connecting with the top wall 12 and the bottom wall 13. The side wall 16 has a fixed groove 150. The two end of the position part 30 is received in the fixed groove 150. The position part 30 defines a plurality of first grooves 31 in one side, the holding section 227 of the first conductive terminal 220 hold in the first groove 31. The rear face 15 of the insulative housing 10 also defines a number of second grooves 140, the holding section 227 of the second conductive terminal 221 hold in the second groove 140. The second insulative plate 204 has a retention portion 25 extending out the first insulative plate 203 in the transverse direction. The insulative housing 10 further defines a retention groove 151 in the side wall 16. The retention portion 25 is fixed in the retention groove 151.

Figure 5:
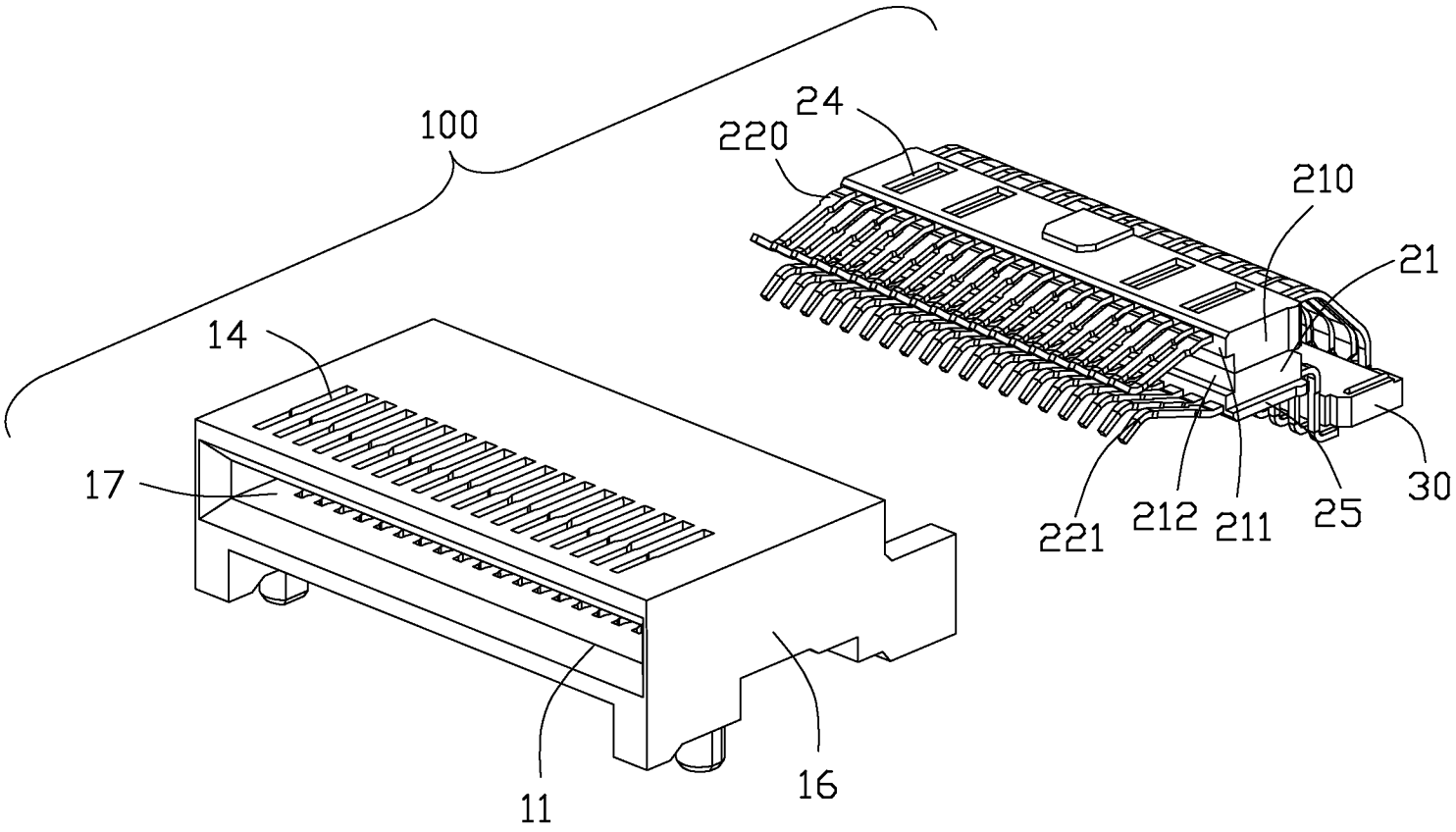
FIG. 5 is another perspective view as shown in FIG. 4.
Figure 7:
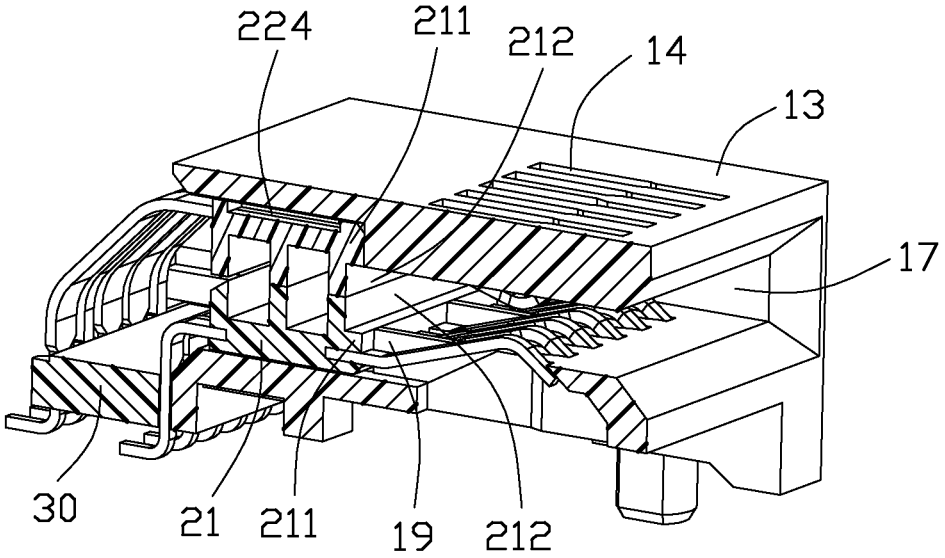
FIG. 7 is a cross-sectional view of the electrical connector taken along line 7-7 of FIG. 1.
Figure 8:
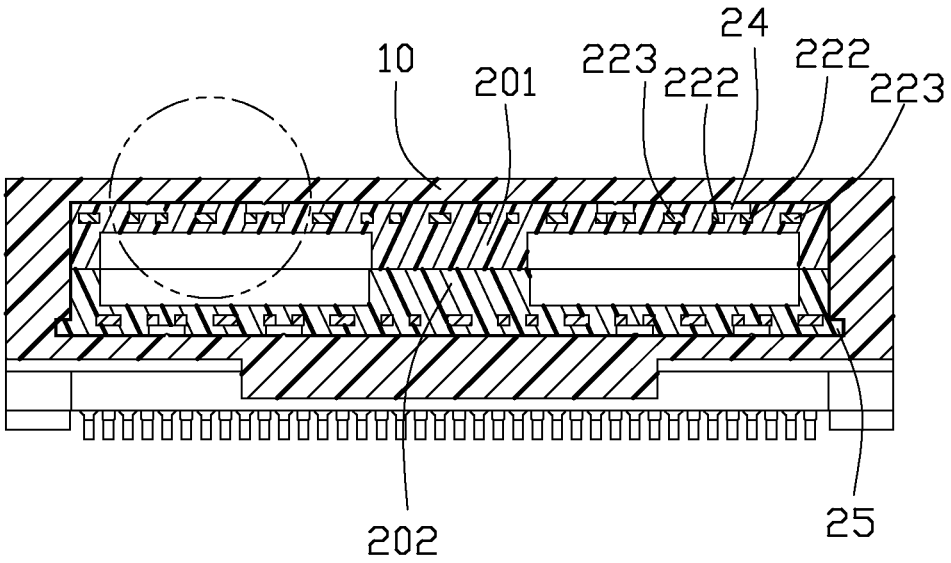
FIG. 8 is a cross-sectional view of the electrical connector taken along line 8-8 of FIG. 1.
Figure 9:
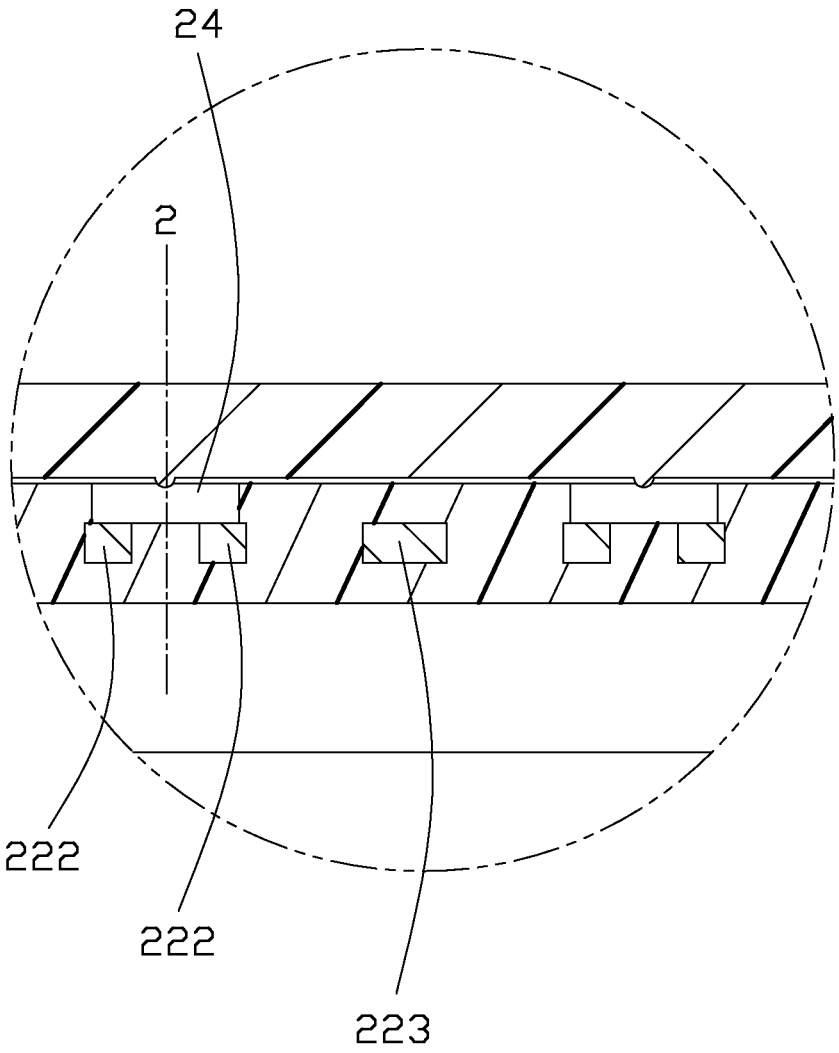
FIG. 9 is partial enlarged drawing of a circle section as shown in FIG. 8.

Referring to FIGS. 5-7, the electrical connector 100 includes a receiving groove 17 extending from the mating port 11. The insulative plate 21 includes a main body 210, a flange 211 forward extending to the side of the receiving groove 17. The main body 210 has a front face 212. The insulative housing 10 has a channel 18 forward running through from the rear face 15. The insulative plate 21 is received in the channel 18 and thus the front face 212 of the main body 210 forms a rear end wall of the receiving groove 17.

Referring to FIG. 4 and FIG. 7, both of the top wall 12 and the bottom wall 13 define a number of ribs 19. When the terminal modules 20 is mounted into the insulative housing 10 along a back-to-front direction, the ribs 19 push the flange 211 of the insulative plate 21 to prevent the terminal module 20 move on.

What is claimed is:

1. An electrical connector comprising:

an insulative housing defining a mating port in a transverse direction, a top wall and a bottom wall horizontally extending in two sides of the mating port, and a plurality of terminal passageways; and a terminal module received in the insulative housing, the terminal module comprising an insulative plate extending along the transverse direction and a plurality of conductive terminals, the conductive terminal having a fixed section insert molded in the insulative plate and a deflectable contact section extending outside of the insulative plate from the fixed section and received in a corresponding terminal passageway, the conductive terminals comprising a plurality of pairs of differential signal terminals for transmitting differential signal;

wherein the insulative plate has a plurality of slots, the slot having two opposite edges, the fixed sections of the pair of differential signal terminals having proximal inner edges, the inner edges being between two opposite edges of the slot; and wherein the slot extends from one side of the insulative plate in a vertical direction to expose a part of the fixed sections of the pair of differential signal terminals.

2. The electrical connector as claimed in claim 1, wherein the terminal module comprises an upper terminal module and a lower terminal module, the upper terminal module comprising a first insulative plate, the lower terminal module comprising a second insulative plate, the first insulative plate aligned with the second insulative plate.

3. The electrical connector as claimed in claim 2, wherein the second insulative plate has a retention portion extending out the first insulative plate, and the insulative housing comprises two side walls connected with the top wall and the bottom wall, the side wall having a retention groove receiving the retention portion.

4. The electrical connector as claimed in claim 2, further comprising a position part, and wherein the insulative housing has a fixed groove fixing the position part, the position part defining a plurality of first grooves in one side of the position part, and the conductive terminals of the upper terminal module are fixed in the first grooves.

5. The electrical connector as claimed in claim 2, wherein the insulative housing defines a rear face having a plurality of second grooves, and the conductive terminals of the lower terminal module are fixed in the second grooves.

6. The electrical connector as claimed in claim 3, wherein the insulative housing has a plurality of ribs on the top wall and the bottom wall, the ribs pressing the insulative plate.

7. The electrical connector as claimed in claim 3, wherein the insulative housing has a channel receiving the insulative plate, and the fixed section of the conductive terminal is fixed in the insulative plate and extends along a front-to-back direction.

8. The electrical connector as claimed in claim 1, further comprising a receiving groove extending from the mating port, and wherein the insulative plate comprises a main body and a flange forwardly extending to a side of the receiving groove, the main body having a front face, the front face constituting a rear end wall of the receiving groove.

9. An electrical connector comprising:

an insulative housing defining a mating cavity forwardly located between opposite first and second walls in a vertical direction and communicating with an exterior in a front-to-back direction perpendicular to said vertical direction, a plurality of passageways arranged along one row in at least one of said opposite first and second walls and along a longitudinal direction perpendicular to both said front-to-back direction and said vertical direction, each of said passageways extending along the front-to-back direction;

a terminal module including an insulator retaining a plurality of contacts in one row, said contacts being categorized with differential pairs and ground contacts alternately arranged with each other along said longitudinal direction;

each of the contacts defining a front deflectable mating section extending into the mating cavity, a rear mounting section exposed upon a bottom face of the housing, a connecting section located between the front mating section and the rear mounting section, said connecting section including a rear connecting segment connected to the mounting section and exposed to a rear side of the housing, and a front connecting segment connected to the front mating section and primarily embedded within said insulator; wherein a plurality of slots are formed within an outer face of the insulator to respectively expose portions of the front connecting segments of the contacts of each differential pair to the exterior in the vertical direction, before the terminal module is assembled into the housing and the front mating sections are received in the corresponding passageways, respectively;

each of the front connecting segments of the contacts in each differential pair is narrower than the corresponding rear connecting segment;

in each differential pair, a distance between opposite inner edges of the front connecting segments is similar to that of the rear connecting segments while a distance between opposite outer edges of the front connecting segments is smaller than that of the rear connecting segments; and in each contact of the differential pair, a cross-section of the front connecting segment is smaller than that of the neighboring grounding contact taken along a first vertical plane extending along the vertical direction and the longitudinal direction while a cross-section of the rear connecting segment is larger than that of the neighboring grounding contact taken along a second vertical plane spaced behind and parallel to the first vertical plane.

10. The electrical connector as claimed in claim 9, wherein in each differential pair, the front connecting segments of the contacts are narrowed in width along said longitudinal direction compared with the corresponding rear connecting segments in a symmetrical way with regard to a center line between said differential pair.

11. The electrical connector as claimed in claim 9, wherein before the terminal module is assembled into the housing, in each differential pair, opposite inner edges of the front connecting segments of the contacts are exposed to the exterior in the vertical direction while the corresponding opposite outer edges of the front connecting segments are hidden under the insulator.

12. The electrical connector as claimed in claim 9, wherein each slot is hidden behind the corresponding wall of the housing so as not to expose the corresponding front connecting segments to the exterior directly in the vertical direction.

13. The electrical connector as claimed in claim 9, wherein the passageways extending through said corresponding one of the opposite first and second walls in the vertical direction to exposed the front contacting sections of the corresponding contacts to the exterior, respectively.

14. An electrical connector comprising:

an insulative housing defining a mating cavity forwardly located between opposite first and second walls in a vertical direction and communicating with an exterior in a front-to-back direction perpendicular to said front-to-back direction, a plurality of passageways arranged along one row in at least one of said opposite first and second walls and along a longitudinal direction perpendicular to both said front-to-back direction and said vertical direction, each of said passageways extending along the front-to-back direction;

a terminal module including an insulator retaining a plurality of contacts in one row, said contacts being categorized with differential pairs and ground contacts alternately arranged with each other along said longitudinal direction;

each of the contacts defining a front deflectable mating section extending into the mating cavity, a rear mounting section exposed upon a bottom face of the housing, a connecting section located between the front mating section and the rear mounting section, said connecting section including a rear connecting segment connected to the mounting section and exposed to a rear side of the housing, and a front connecting segment connected to the front mating section and primarily embedded within said insulator; wherein in each differential pair, the front connecting segments of the contacts are narrowed in width along said longitudinal direction, compared with the corresponding rear connecting segments, in a symmetrical way with regard to a center line between said differential pair;

in each differential pair, a distance between opposite inner edges of the front connecting segments and that between opposite inner edges of the rear connecting segments are similar to each other while a distance between opposite outer edges of the front connecting segments is smaller than that between opposite outer edges of the rear connecting segments; and the insulator forms a plurality of slots each in alignment with a corresponding differential pair in the vertical direction, and each of said slots extends through an exterior surface of the insulator and is large enough to expose the opposite inner edges of the front connecting segments while being small enough to keep the opposite outer edges of the front connecting segments unexposed.

* * * * *